US005764199A

United States Patent [19]

Ricardi

[11] Patent Number: 5,764,199

[45] Date of Patent: Jun. 9, 1998

[54] LOW PROFILE SEMI-CYLINDRICAL LENS ANTENNA ON A GROUND PLANE

[75] Inventor: Leon J. Ricardi, El Segundo, Calif.

[73] Assignee: Datron/Transco, Inc., Simi Valley, Calif.

[21] Appl. No.: 700,231

[22] Filed: Aug. 20, 1996

Related U.S. Application Data

[60] Provisional application No. 60/002,868, Aug. 28, 1995.

[51] Int. Cl.[6] ..... H01Q 15/08

[52] U.S. Cl. ..... 343/911 R; 343/911 L; 343/753

[58] Field of Search ..... 343/753, 754, 343/755, 761, 846, 848, 911 L, 911 R

[56] References Cited

U.S. PATENT DOCUMENTS

| | | | |
|---|---|---|---|
| 3,886,561 | 5/1975 | Beyer | 343/911 R |
| 3,972,043 | 7/1976 | Louis | 343/911 L |
| 4,001,835 | 1/1977 | Dover et al. | 343/754 |
| 4,531,129 | 7/1985 | Bonebright et al. | 343/754 |
| 4,608,572 | 8/1986 | Blakney et al. | 343/846 |
| 4,642,651 | 2/1987 | Kuhn | 343/754 |
| 4,755,820 | 7/1988 | Backhouse et al. | 343/753 |
| 4,973,965 | 11/1990 | Ridge et al. | 343/911 L |
| 5,084,711 | 1/1992 | Moss et al. | 343/911 L |
| 5,398,037 | 3/1995 | Engheta et al. | 343/753 |
| 5,455,589 | 10/1995 | Huguenin et al. | 343/753 |
| 5,528,254 | 6/1996 | Howng et al. | 343/753 |
| 5,625,368 | 4/1997 | Howson et al. | 343/911 L |

*Primary Examiner*—Donald T. Hajec
*Assistant Examiner*—Tan Ho
*Attorney, Agent, or Firm*—Edward A. Sokolski

[57] ABSTRACT

A semi-cylindrical dielectric lens antenna on a ground plane for focusing radiation from a line source adjacent to the semi-cylinder. Grooves in the surface of the ground plane modify the polarization of the electromagnetic radiation reflected by the ground plane thus allowing conversion of radiation from linear to circular polarization and vice versa. Selectable line sources may be used to provide both right and left hand circularly polarized radiation. The entire antenna and ground plane may be rotated and the line source may be moved relative to the dielectric lens so as to scan the antenna beam over a hemisphere.

15 Claims, 3 Drawing Sheets

LOW PROFILE SEMI-CYLINDRICAL LENS ANTENNA ON A GROUND PLANE

This application claims the benefit of U.S. Provisional Application No. 60/002,868, filed Aug. 28, 1995 and titled "A Low Profile Lens Antenna".

BACKGROUND OF THE INVENTION a. Field of the Invention

This invention pertains to microwave antennas. More particularly this invention pertains to microwave scanning lens antennas.

b. Description of the Prior Art

Microwave antennas that utilize a spherical dielectric lens are well known in the art. See e.g. Braun, E. H., "RadiatiLon Characteristics of Spherical Luneberg Lens", IRE Transactions on Antennas and Propagation, Apr. 1956, pages 132–138; Kay, A. F., "Spherically Symmetric Lenses", IRE Transactions on Antennas and Propagation, Jan. 1959, pages 32–38; Luneberg, R. K., Mathematical Theory of Optics, Brown University, Providence, Rhode Island, 1944, pages 189 to 213 ; Morgan, S. P., "General Solution of the Luneberg Lens Problem", Journal of Applied Physics, Sep. 1958, pages 1358–1368; Morgan, S. P., "Generalizations of Spherically Symmetric Lenses", IRE Transactions on Antennas ind Propagation, Oct. 1959, pages 342–345; Peeler, G. D. M., and H. P. Coleman, "Microwave Stepped-Index Luneberg Lenses", IRE Transactions on Antennas and Propagation, Apr. 1958, pages 202–207; "Luneberg and Einstein Lenses", Sec. 14–10, Antennas, J. Kraus, McGraw-Hill Book Company, 2 nd. Ed., pp. 688–690; "The Geodesic Luneberg Lens"by Richard C. Johnson, The Microwave Journal, Aug. 1962, pp. 76–85.

Although the prior art may include a microwave lens antenna that uses a cylindrical lens to focus the radiation from a line source into a beam, applicant is unaware of a specific reference that discloses such an antenna.

A microwave lens antenna that utilizes a lens comprising one-half of a dielectric sphere (a "semi-sphere") mounted upon a ground plane, where the reflection from the ground plane, in effect, provides the second half of the dielectric sphere is also known in the prior art. See e.g. "Lenses for Direction of Radiation", Sec. 12.19, Fields and Waves in Communication Electronics, Ramo, Whinnery, and Van Duzer, John Wiley & Sons, pp. 676–678. A microwave lens antenna that utilizes one-half of a dielectric cylinder (a "semi-cylinder") mounted upon a ground plane to focus radiation from a line source, however, is not known in the prior art.

SUMMARY OF THE INVENTION

The present invention utilizes a dielectric lens in the form of a semi-cylinder mounted on a ground plane to focus into a pencil or fan beam the energy radiated from a line source located near the surface of the semi-cylinder. When mounted upon the fuselage of an aircraft, the semi-cylindrical lens has an advantage over a cylindrical lens in free space in that the semi-cylindrical lens extends only one-half as far outside of the fuselage and into the airstream as compared to a complete cylindrical lens. As a consequence, the semi-cylindrical lens is a "low-profile" antenna.

It should be understood that although for simplicity of description the invention may be described as radiating electromagnetic energy, the invention may also be used for the reception of electromatic energy and, in the preferred embodiment, the antenna is used for this purpose.

The present invention also utilizes a series of grooves in the surface of the ground plane to alter the polarization of the radiation that is radiated from, or received by, the line source. The grooves are be used to transform the radiation from a line source of linearly polarized radiation into circularly (or elliptically) polarized radiation. If two independent, linearly polarized, line sources having orthogonal polarizations with respect to each other are used as the line source, then the grooves can be used to provide a right circularly polarized radiation pattern from the first line source and a left circularly polarized radiation pattern from the second line source, or vice versa. More generally, the grooves may be used to alter the ellipticity of radiation reflected by the ground plane.

DETAILED DESCRIPTION

Figure 1:
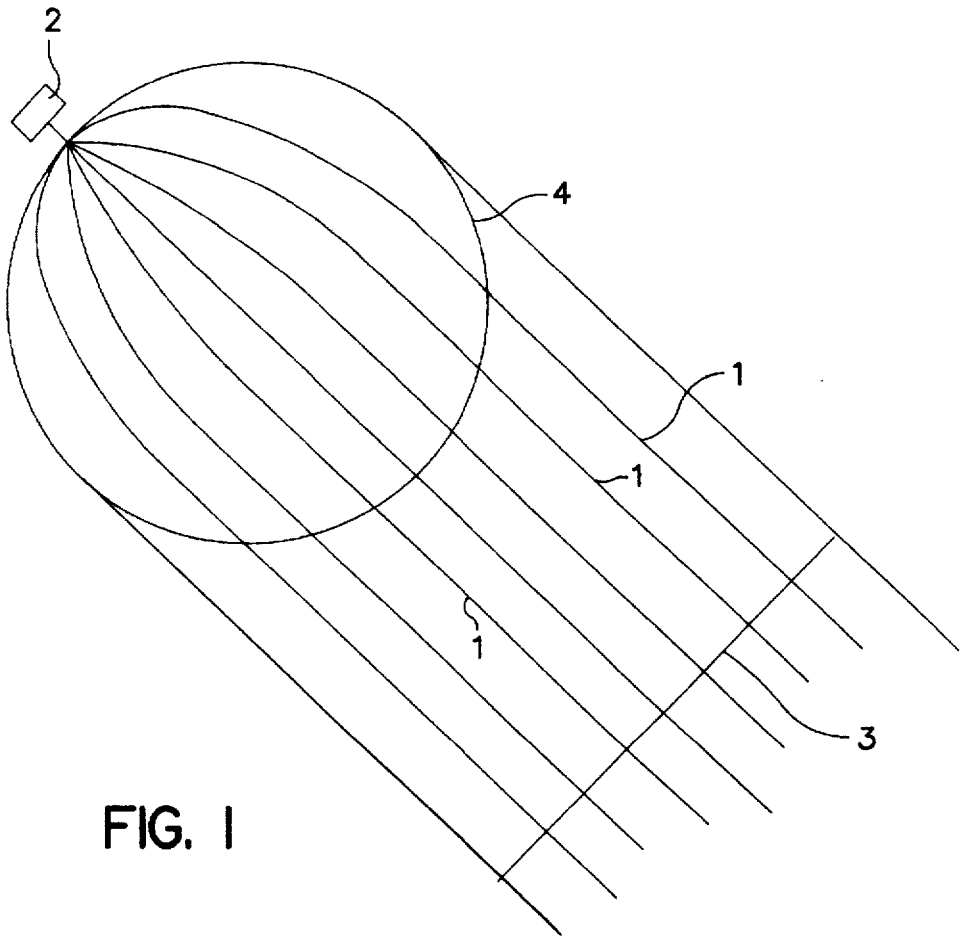
FIG. 1 depicts the paths of rays emanating from a line source that are focused into a plane wave by a cylindrical lens.
Figure 2:
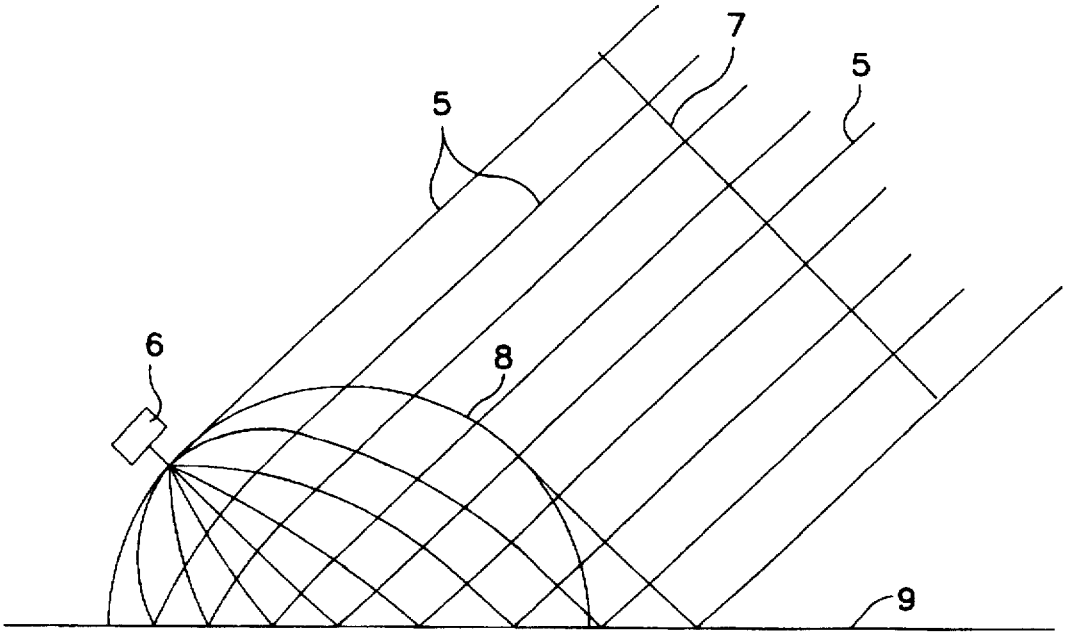
FIG. 2 depicts the paths of rays emanating from a line source that are focused into a plane wave by a semi-cylindrical lens mounted on a ground plane.

FIG. 1 depicts the paths of rays 1 emanating from a line source 2 that are focused into a plane wave 3 by a cylindrical lens 4. FIG. 2 depicts the paths of rays 5 emanating from a line source 6 that are focused into a plane wave 7 by a semi-cylindrical lens 8 mounted upon a ground plane 9. As indicated in Fig. 2, the rays 5 emanating from line source 6 and passing through lens 8 are reflected by ground plane 9. Depending upon the location of rays 5 relative to semi-cylindrical lens 8 and ground plane 9, after reflection by ground plane 9 the rays may or may not pass through a further portion of lens 8. As may be seen from FIGS. 1 and 2, except for a change in direction, the plane wave depicted in FIG. 2 that is formed by semi-cylindrical lens 8 and ground plane 9 has the same form as the plane wave depicted in FIG. 1 that is formed by cylindrical clindrical lens 4.

Figure 3:
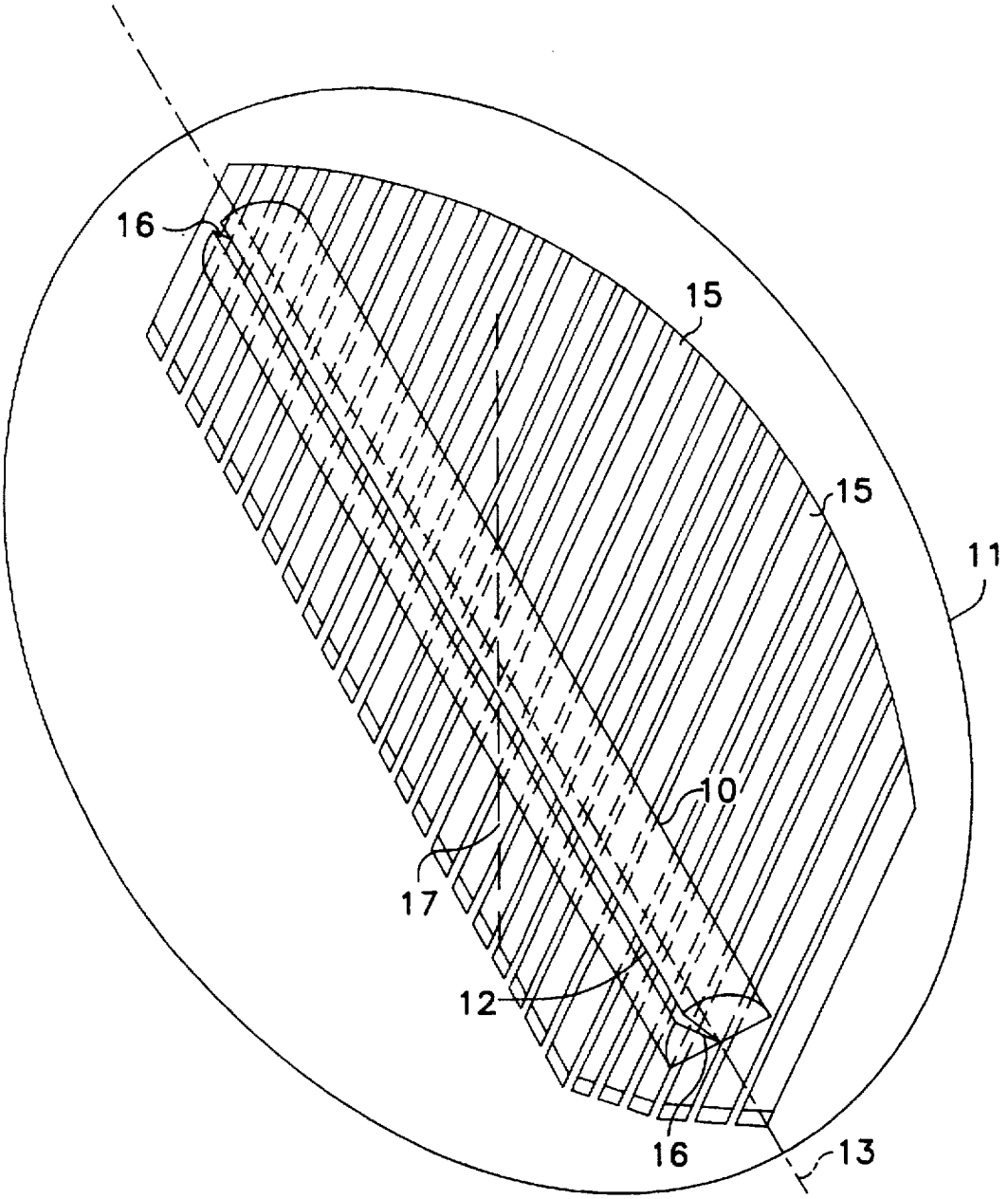
FIG. 3 is a pictorial view of the invention.

Referring to FIG. 3, the present invention uses a dielectric lens 10, having the general shape of one-half of a cylinder, i.e. a "semi-cylinder", that is mounted on ground plane 11 so as to form a lens that focuses the radiation pattern from line source 12 into a beam. Ground plane 11 reflects the energy incident thereon and by the reflection, in effect, provides a second one-half of the dielectric lens so that the combination of the semi-cylindrical lens and the ground plane together give the effect of a complete cylindrical lens. Although the beam generated by the antenna may be in the form of a "pencil" beam or a "fan" shaped beam, it should be understood that actual shape of the beam generated by the lens, line source and ground plane will depend upon the relative dimensions of the dielectric lens, the line source and the manner in which the lens is illuminated by the line source.

Figure 4:
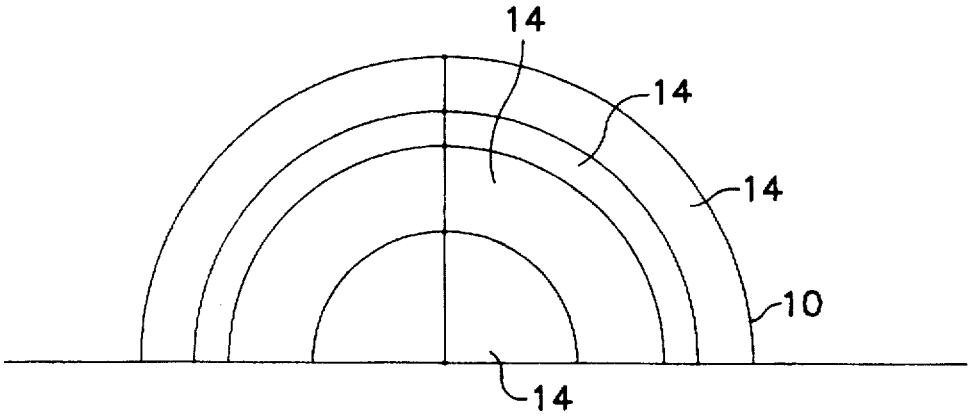
FIG. 4 is an end view of the semi-cylindrical lens fabricated from concentric dielectric semi-cylinders having "stepped" dielectric constants.

For a classical Luneberg Lens, the variation of the relative dielectric constant, $e_r$, for lens 10 would vary as a function of radial distance, r, from the axis 13 of the lens according the the formula:

$$e_r=2-(2r/D)^2 \quad (1)$$

where D is the diameter of the semi-cylindrical lens. However, as indicated in FIG. 4, in the preferred embodiment, dielectric lens 10 consists of a series of concentric dielectric cylinders 14, with each dielectric cylinder having a constant, but different dielectric constant so that the dielectric properties of the lens will be circularly symmetric (over a half-space) about the axis 13 of lens 10. The "stepped" dielectrics provide an approximation to a lens having a continuously varying dielectric constant and simplify the fabrication of the antenna. As an example, one embodiment of the invention that approximates a Luneberg lens may consist of four dielectric semi-cylinders made of polystyrene beads which have stepped relative dielectric constants and relative radial dimensions given as follows:

| radius | relative dielectric constant |
|---|---|
| 0–1.106 | 1.942 |
| 1.107–1.900 | 1.654 |
| 1.901–2.250 | 1.46 |
| 2.251–2.7 | 1.332 |

It should be understood, however, that a different number of semi-cylinders could, instead, be used and that different values of dielectric constants could be used to approximate a Luneberg lens and, of course, that a dielectric material having a dielectric constant that varies continuously as a function of the radial distance from the axis of the semi-cylinder could be used to form the lens. Furthermore, artificial dielectrics, such as distributed, small spherical conductors, could be used to, in effect, provide a media having a variable dielectric constant. Accordingly, the term "dielectric" should be understood to encompass all means for providing a relative dielectric constant differing from that of free space.

Furthermore, although in the preferred embodiment, the stepped dielectric is used to approximate the dielectric properties of a Luneberg lens, other types of lens such as a "constant K" lens could be used to focus the radiation from line source 12 into a beam.

Referring again to FIG. 3, line source 12 is depicted as being located very near to the surface of dielectric lens 10. in the preferred embodiment the spacing between line source 12 and the surface of dielectric lens 10 is adjusted, however, so as to cause dielectric lens 10 to focus the radiation from line source 12 at infinity so as to generate a plane wave. The actual spacing is dependent upon the effective dielectric properties of the "stepped" lens and upon the effective phase center of the line source, i.e. upon the location of the line in space from which the radiation from the line source appears to emanate. In the preferred embodiment, because the semi-cylindrical lens that is approximated by the stepped values of dielectric material includes an outermost "step" that has a relative dielectric constant of 1, i.e. in which there is no polystyrene, the line source is offset somewhat from the actual surface of the outermost dielectric semi-cylinder. It should also be understood that in some applications, a spacing may be used that provides a focus at some distance other than at infinite.

Referring still to FIG. 3, in the preferred embodiment ground plane 11 has a series of grooves 15 on its surface, which grooves 15 are oriented at an angle of approximately 45 degrees to axis 13. In the preferred embodiment the spacing between the grooves is approximately 0.5 wavelengths, and normally should be less than 0.6 wavelengths. The grooves alter the polarization of the radiation reflected from the ground plane such that a linearly polarized electromagnetic wave incident upon the ground plane will be reflected as a circularly, or elliptically polarized wave, or vice versa, or some combination thereof. The general principals for the design of grooves so as to alter the polarization of electromagnetic waves reflected therefrom are known in the prior art. See e.g. "Transmission and Reflection Type Polarizers", sec. 23–5, Antenna Engineering Handbook, Johnson and Jasik, McGraw Hill, 2nd Ed., pp. 23–25 to 23–28.

If line source 12 consists of two independently fed line sources having differing polarizations, e.g. one line source having linear polarization aligned with axis 13 of the lens and a second line source having linear polarization oriented orthogonally to axis 13, then the two line sources can be used independently to obtain differing polarizations in the energy reflected by ground plane 11, e.g. right-hand circularly polarized radiation and left-hand circularly polarized radiation. On the other hand if line source 12 is circularly polarized, then the lens and ground plane can be used to focus the radiation into a circularly or elliptically polarized beam without need for any grooves in ground plane 11. Similarly, if line source 12 consists of two independently feed line sources having differing polarizations, e.g. right and left and circularly polarized, then the two independent line sources can be used to obtain simultaneous orthogonal circular or elliptical polarizations without need for the grooves in ground plane 11.

In the preferred embodiment, line source 12 is mounted on arms 16 hinged at axis 13 so that line source 12 may be rotated about axis 13 so as to scan the beam reflected from ground plane 11. In the preferred embodiment, ground plane 11 is rotatably mounted about its central axis 17 so that in applications where the ground plane is oriented approximately parallel to the surface of the earth, the beam generated by the lens may be scanned 360 degrees in azimuth by rotation of the ground plane about axis 17 and may be scanned from near the horizon to a near vertical position by moving the line source through a range of approximately 90 degrees, i.e. from a position adjacent to the ground plane to a position atop the dielectric lens. In the preferred embodiment the line source source is moved through an angular range of less than 90 degrees and always remains on one side of the lens and the beam from the lens is always directed to one side of the lens, i.e. to the side of the lens opposite to the lines source. As a practical consequence of these limitations on the movement of the line source, the grooves in the ground plane need only be located under the lens and on the side of the lens that is opposite to the line source in order to affect the polarization of the radiation reflected by the ground plane.

Figure 5:
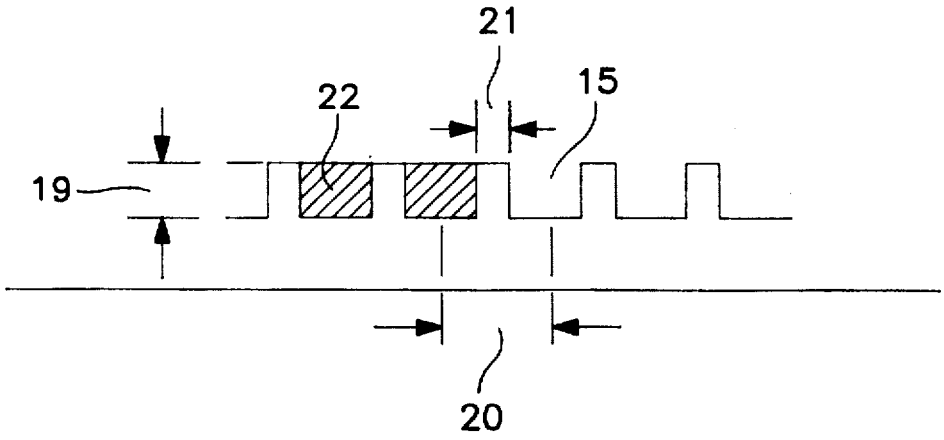
FIG. 5 is a cross-sectional view of the grooves in the ground plane, some of which grooves are depicted as being filled with a dielectric.

Referring to FIG. 5, for an electromagnetic wave that is incident on the ground plane at an angle of zero degrees with respect to the normal to the ground plane and that is linearly polarized with the polarization parallel to the surface of the ground plane, then for grooves 18 in the surface of the ground plane and oriented at an angle of approximately 45 degrees to polarization of the incident wave, the grooves will convert a linearly polarized incident wave to a circularly polarized reflected wave if the grooves have a depth 19 of 0.125 wavelengths, a groove spacing 20 of 0.5 wavelengths and a wall thickness 21 of 0.1 wavelengths. Because the effect of the grooves upon the reflected radiation is dependent upon the angle of incidence, the polarization of the wave reflected from the grooves will vary as the angle of incidence changes. In order to compensate for this effect, in the preferred embodiment of the invention, which is designed to operate over a range of reflection angles of from 20 degrees to 70 degrees, the depths of the grooves are varied from a maximum of 0.125 wavelengths in the region immediately beneath the dielectric lens to a minimum depth of approximately 0.01 wavelengths at the outer edge of the grooved portion of the ground plane. When the antenna is to operate over a range of reflection angles, the change in the depths of the grooves as a function of distance from the axis of the lens is adjusted so as to obtain approximately the desired polarization of the reflected wave over the range of reflection angles. As a consequence, the purity of the polarization over the range of reflection angles is degraded from that which might otherwise be obtained if the grooves were designed for a fixed angle of reflection. In the preferred embodiment the ground plane is grooved only in approximately those portions of the ground plane for which ray-tracing techniques indicate there will be significant incident and reflected waves.

As depicted in FIG. 5, the grooves also may be filled with a dielectric 22 which will alter the relationship between the dimensions of the grooves and alter the effect of the grooves upon the polarization of the reflected radiation. Although FIG. 5 depicts only some of the grooves as being filled with a dielectric 22 it should be understood that in the preferred embodiment none. of the grooves are filled with a dielectric and that another embodiment could have some or all of the grooves filled with a dielectric.

I claim:

1. An antenna comprising:

a ground plane having an upper surface, a lens having the form of a semi-cylinder, the lens having a flat side coincident with the axis of the semi-cylinder and having a curved semi-cylindrical surface centered upon said axis, said flat side of the lens being substantially adjacent to the upper surface of the ground plane, a line source located outside of the lens and in proximity to the curved semi-cylindrical surface of the lens, said line source being oriented substantially parallel to the axis of the semi-cylinder.

2. The antenna of claim 1 wherein the line source is afixed in a hinging manner about the axis of the semi-cylinder.

3. The antenna of claim 1 wherein the lens comprises a dielectric.

4. The antenna of claim 3 wherein the lens comprises a dielectric having a relative dielectric constant that varies as a function of radial distance from the axis of the semi-cylinder.

5. The antenna of claim 4 wherein the relative dielectric constant of the lens varies approximately in accord with the equation $e_r$_2–(2*r/D)$^2$, where "D" is equal to the diameter of the semi-cylinder and r is the radial distance from the axis of the semi-cylinder.

6. The antenna of claim 3 wherein the antenna includes polarization means for changing the polarization of radiation reflected by the ground plane.

7. The antenna of claim 3 wherein the ground plane includes a plurality of parallel grooves in the upper surface of the ground plane.

8. The antenna of claim 7 wherein the grooves are oriented at an angle of approximately 45 degrees to the axis of the lens.

9. The antenna of claim 8 wherein the grooves have widths and separating walls having a thickness, the widths of the grooves being less than approximately ½ of a wavelength, and the thickness of the separating walls being less than approximately 1/10 of a wavelength and the grooves being spaced at intervals of less than approximately ½ of a wavelength from each other.

10. The antenna of claim 7 and further comprising a dielectric material located within said grooves.

11. The atenna of claim 1 wherein the ground plane includes a plurality of parallel grooves in the upper surface of the ground plane.

12. The antenna of claim 1 where in the line source comprises a plurality of independent line sources.

13. The antenna of claim 1 wherein the entire antenna is rotatably mounted about an axis passing through the ground plane.

14. An antenna comprising:

a ground plane having an upper surface and having a plurality of parallel grooves in the upper surface of the ground plane, a dielectric lens having the form of a semi-cylinder, the lens having a flat side coincident with the axis of the semi-cylinder and having curved semi-cylindrical surface centered upon said axis, said flat side of the lens being substantially adjacent to the upper surface of the ground plane, a line source located outside of the lens and in proximity to the curved semi-cylindrical surface of the lens, said line source being oriented substantially parallel to the axis of the semi-cylinder, the line source being afixed in a hinging manner about the axis of the semi-cylinder.

15. The antenna of claim 14 wherein the entire antenna is rotatably mounted about an axis passing through the ground plane.

* * * * *